US007091935B2

(12) United States Patent
Yun et al.

(10) Patent No.: US 7,091,935 B2
(45) Date of Patent: Aug. 15, 2006

(54) METHOD OF DRIVING PLASMA DISPLAY PANEL USING SELECTIVE INVERSION ADDRESS METHOD

(75) Inventors: Sang Jin Yun, Pohang-shi (KR); Gop Sick Kim, Kumi-shi (KR); Yun Kwon Jung, Pohang-shi (KR); Bong Koo Kang, Pohang-shi (KR); Young Hwan Kim, Pohang-shi (KR); Ju Won Seo, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 424 days.

(21) Appl. No.: 10/103,754

(22) Filed: Mar. 25, 2002

(65) Prior Publication Data

US 2002/0135546 A1 Sep. 26, 2002

(30) Foreign Application Priority Data

Mar. 26, 2001 (KR) ..... 2001-15754
Mar. 12, 2002 (KR) ..... 2002-13365

(51) Int. Cl.
*G09G 3/28* (2006.01)

(52) U.S. Cl. ..... 345/66; 345/60

(58) Field of Classification Search ..... 345/60–63, 345/66–68, 74.1, 76, 208; 313/484, 491, 313/514, 517, 520; 315/169.4
See application file for complete search history.

(56) References Cited

U.S. PATENT DOCUMENTS 5,745,086 A 4/1998 Weber ..... 345/63
6,118,220 A * 9/2000 Shino et al. ..... 315/169.4
6,181,205 B1 1/2001 Nguyen et al. ..... 345/60
6,653,795 B1 * 11/2003 Kang et al. ..... 315/169.3
6,667,728 B1 * 12/2003 Kanazawa et al. ..... 345/60
6,900,797 B1 * 5/2005 Hirakawa et al. ..... 345/208
2002/0067321 A1 * 6/2002 Kanazawa et al. ..... 345/60

FOREIGN PATENT DOCUMENTS

| | | |
|---|---|---|
| EP | 0 855 691 A1 | 7/1998 |
| EP | 0 866 439 A1 | 9/1998 |
| EP | 0 977 169 A1 | 2/2000 |
| JP | 08-160910 | 6/1996 |
| JP | 08-328507 | 12/1996 |
| JP | 11-065524 | 3/1999 |
| JP | 11-133913 | 5/1999 |
| JP | 2000-501199 | 2/2000 |
| JP | 2000-214822 | 8/2000 |
| JP | 2001-184021 | 7/2001 |
| KR | 1020020001538 A | 1/2002 |

* cited by examiner

*Primary Examiner*—Ricardo Osorio
*Assistant Examiner*—Mansour M. Said
(74) *Attorney, Agent, or Firm*—Fleshner & Kim, LLP

(57) ABSTRACT

A method of driving a plasma display panel wherein a selective inversion system is used to perform an address operation. In the method, a reset step makes an entire write discharge of the cells to form wall charges. An address step makes an address discharge of specific cells of the cells undergoing said entire write discharge to invert the polarities of the wall charges of said specific cells and to keep the polarities of the wall charges according to said entire write discharge as they are at the remaining cells excluding said specific cells. A sustain step makes a sustain discharge of only the specific cells having the inverted wall charge polarity by a sustain pulse. Accordingly, a data is written by the selective inversion addressing method to permit a high-speed driving and to prevent a contrast deterioration.

10 Claims, 14 Drawing Sheets

METHOD OF DRIVING PLASMA DISPLAY PANEL USING SELECTIVE INVERSION ADDRESS METHOD

BACKGROUND OF THE INVENTION

1. Field of the Invention

This invention relates to a method of driving a plasma display panel, and more particularly to a method of driving a plasma display panel wherein a selective inversion system is used to perform an addressing operation.

2. Description of the Related Art

Recently, a plasma display panel (PDP) feasible to a manufacturing of a large-dimension panel has been highlighted as a flat panel display device. The PDP usually controls a discharge period of each pixel in accordance with a digital video data to thereby display a picture. The PDP typically includes a three-electrode, alternating current (AC) type PDP that has three electrodes and is driven with an AC voltage as shown in FIG. 1.

FIG. 1 shows a structure of each discharge cell arranged in a matrix type in a conventional AC type PDP.

Referring to FIG. 1, the PDP includes an upper plate provided with a sustain electrode pair 12A and 12B, an upper dielectric layer 14 and a protective film 16 that are sequentially formed on an upper substrate 10 of the discharge cell, and a lower plate provided with a data electrode 20, a lower dielectric layer 22, barrier ribs 24 and a fluorescent layer 26 that are sequentially formed on a lower substrate 18 thereof. The upper substrate 10 and the lower substrate 18 are spaced in parallel by the barrier ribs 24. Each of the sustain electrode pair 12A and 12B consists of a transparent electrode having a relatively large width to transmit a visible light and a metal electrode having a relatively small width to compensate for a resistance component of the transparent electrode. Such a sustain electrode pair 12A and 12B consists of a scan electrode 12A and a sustain electrode 12B. The scan electrode 12A mainly applies a scan signal for a panel scanning and a sustain signal for a discharge sustaining, whereas the sustain electrode 12B mainly applies a sustain signal. Electric charges are accumulated in the upper and lower dielectric layers 14 and 22. The protective film 16 prevents a damage of the upper dielectric layer 14 caused by the sputtering to prolong a life of the PDP as well as to improves the emission efficiency of secondary electrons. This protective film 16 is usually made from MgO.

These dielectric layers 14 and 22 and protective film 16 can lower a discharge voltage applied from the exterior thereof. A data electrode 20 crosses the sustain electrode pair 12A and 12B. This data electrode 20 supplies a data signal for selecting cells to be displayed. The barrier ribs 24 are formed in parallel to the data electrode 20 to prevent a ultraviolet ray generated by the discharge from being leaked into adjacent cells. The fluorescent layer 26 is coated on the surfaces of the lower dielectric layer 22 and the barrier ribs 24 to generate any one of red, green and blue visible lights. A discharge space is filled with an inactive gas, such as He, Ne, Ar, Xe and Kr, etc., for a gas discharge, a discharge gas consisting of a combination of said inactive gases or an Excimer gas capable of generating an ultraviolet ray by the discharge.

The discharge cell having the structure as mentioned above is selected by an opposite discharge between the data electrode 20 and the scan electrode 12A to keep the discharge by the surface discharge between the sustain electrode pair 12A and 12B. In the discharge cell, the fluorescent layer 26 is radiated by an ultraviolet ray generated upon sustain discharge to emit a visible light into the exterior of the cell. In this case, the discharge cell controls a discharge sustain period, that is, a sustain discharge frequency of the cell in accordance with a video data to implement a gray scale required for an image display.

FIG. 2 shows an electrode arrangement structure of a three-electrode, AC type PDP having the discharge cells shown in FIG. 1 arranged in a matrix type.

Referring to FIG. 2, a discharge cells 30 is provided at each intersection among scan electrode lines Y1 to Ym, sustain electrode lines Z1 to Zm and data electrode lines X1 to Xn. The scan electrode lines Y1 to Ym apply scan pulses and sustain pulses to scan the discharge cells 30 for each line and keep the discharge at the discharge cells 30. The sustain electrode lines Z1 to Zm commonly applies sustain pulses to keep the discharge at the discharge cells 30 along with the scan electrode lines Y1 to Ym. The data electrode lines X1 to Xn applies data pulses synchronized with the scan pulses for each line to select the discharge cells 30 in accordance with logical values of the data pulses.

Such a PDP driving method typically includes an address and display separation (ADS) driving method wherein the PDP is driven with being divided into an address period and a display period, that is, a discharge sustain period. In the ADS driving method, as shown in FIG. 3, one frame 1F is divided into 8 sub-fields SF1 to SF8 corresponding to each bit of 8-bit image data. Each sub-field SF1 to SF8 is again divided into a reset period RPD, an address period APD and a sustain period SPD.

The reset period RPD provides an initial condition for permitting the next addressing operation. In other words, the reset period RPD allows wall charges to have a reproducible and constant state just before the address period APD for the purpose of providing each cell with a stable operation having a uniform brightness. The address period APD selects cells to be turned on and cells to be turned off depending upon the data pulses. The sustain period SPD keeps a discharge for the cells having turned on in the address period APD. The reset period RPD and the address period APD of each sub-field SF1 to SF8 are equal, and the sustain period SPD is given with a weighting value of a ratio of $2^0:2^1:2^2: \ldots :2^{n-1}$ to express a gray scale by a combination of the sustain periods SPD.

In such an ADS driving method, the addressing method is largely classified into a selective write method and a selective erase method.

FIG. 4 is a flow chart representing a driving sequence of one sub-field according to the selective write addressing method.

The selective write addressing method applies above a discharge initiation voltage between the scan electrode and the data electrode so as to selectively turn on the discharge cells in accordance with a data to thereby generate a discharge.

More specifically, at step S10, an entire write discharge is generated at all the cells of the panel with the aid of the reset pulse and thereafter is turned to an off state having the residual wall charges so as to initialize the PDP. At steps S12 to S16, the cells are selected in accordance with a display data such that a write discharge is generated at the cells to be turned on with the aid of the scan pulses and the data pulses and a discharge is not generated at the cells to be turned off. At step S18, a sustain operation is performed during the corresponding interval of the on/off state of the cell determined at said steps S14 and S16 to thereby realize a gray scale. Particularly, the cells having the on state by the write discharge at said step S14 keeps the discharge during the corresponding interval. Subsequently, at step S20, an erasure operation allowing all the cells to have an off state is performed to prepare the next sub-field operation. At the next sub-field, the PDP repeats the operations of said steps S10 to S20.

FIG. 5 is a driving waveform diagram for explaining the PDP driving method employing the above-mentioned selective write addressing method. Herein, X represents a signal waveform applied to the data electrode 20; Y represents a signal waveform applied to the scan electrode 12A; and Z represents a signal waveform applied to the sustain electrode 123, in one sub-field interval.

In FIG. 5, in the reset period RPD, an entire write discharge is generated with the aid of a reset pulse RP and thereafter wall charges are erased, thereby initializing the cells into an off state having the residual wall charges.

More specifically, the reset pulse RP has a positive-going ramp pulse slowly increasing into a peak voltage Vr on a basis of a step voltage Vs and a negative-going ramp pulse slowing decreasing into a ground voltage (0V). By this positive-going ramp pulse, a primary dark discharge is generated between the scan electrode 12A and the sustain electrode 12B and between the scan electrode 12A and the data electrode 20. This dark discharge forms negative wall charges on the scan electrode 12A while forming positive wall charges on the sustain electrode 12B and the data electrode 20. Then, a secondary dark discharge is generated between the two electrodes 12A and 12B with the aid of the negative-going ramp pulse applied to the scan electrode 12A and a bias voltage pulse BP applied to the sustain electrode 12B. Subsequently, since the scan electrode 12A pulls positive ions generated by the secondary dark discharge while the sustain electrode 12B pulls electrons, wall charges formed on the scan electrode 12A and the sustain electrode 12B are reduced in accordance with a decrease of the negative-going ramp voltage. In this case, the polarities of the scan electrode 12A and the sustain electrode 12B can be inverted depending upon a voltage condition of the negative-going ramp voltage. Herein, if negative wall charges are left at the sustain electrode 12B, then they help a sustain discharge caused by the first sustain pulse in the sustain period SPD with the lapse of the address period APD. During such an application of the negative-going ramp pulse, a voltage of the data electrode 20 is fixed to a ground voltage 0V. Thus, the wall charges formed on the data electrode 20 by said positive-going ramp pulse cancels an external electric field, so that a discharge is not generated between the scan electrode 12A and the data electrode 20. Furthermore, since an amount of the wall charges formed on the scan electrode 12A by the secondary dark discharge is reduced, an address voltage applied to the scan electrode 12A or the data electrode 20 in the following address period SPD must be increased.

In the address period APD, a scan pulse SP having a voltage of Vsc is applied to the scan electrode 12A for each line and, at the same time, a data pulse DP having a voltage of Vd is applied to the data electrode 20 of the cell corresponding to a data '1', thereby generating an address discharge. By this address discharge, the scan electrode 12A and the sustain electrode 12B are turned to an on state in which wall charges for the next sustain discharge are sufficiently formed. An amount of the wall charges formed by the address discharge is increased in accordance with an increase of the bias voltage BP applied to the sustain electrode 12B. Otherwise, since a voltage between the scan electrode 12A and the data electrode 20 fails to exceed a firing initiation voltage at the cells corresponding to a data '0' and supplied with only the scan pulse SP, a discharge is not generated to keep an off state.

In the address period APD, when an address operation for each line has been finished, sustain pulses SUSPy and SUSPz are alternately to the scan electrode 12A and the sustain electrode 12B in the next sustain period SPD to keep a state of the cell determined in said address period. More specifically, the cells having an on state in which wall charges are sufficiently formed in the address period APD keep an on state owing to a discharge caused by the sustain pulses SUSPy and SUSPz, whereas the cells having an off state keep an off state as they are without any discharge.

In the erase period EPD following such a sustain period SPD, an erase pulse EP is applied to the sustain electrode 12B to cause an erasure discharge, thereby erasing wall charges existing in all the cells. In this case, a positive-going pulse is applied as the erase pulse EP so as to provide a small light-emission magnitude.

Such a selective write addressing method requires a write discharge interval of more than about 3 μs in order to sufficiently form wall charge required for the next sustain discharge with the aid of a write discharge according to a data pulse. Accordingly, there is raised a problem in that, since each of the scan pulse and the data pulse must have a pulse width of more than about 3 μs, the address period is lengthened and hence the sustain period becomes relatively insufficient, thereby causing a low brightness. Moreover, there occurs a problem in that, since the address period is more lengthened when it is intended to realize a high resolution picture, a gray level implementation becomes impossible due to a lack of the sustain period.

For instance, when red (R), green (G) and blue (B) discharge cells, 256 gray levels (8 bits) and a frame frequency of 60 Hz are considered for a high resolution of 1280×1024, a data amount to be processed is 1.75 Gbits (i.e., 1024×1280×3×8×60) per second, 30 Mbits (i.e., 1024×1280×3×8 bits) per frame (16.67 ms in the case of an image signal adopting the NTSC system) or 30 Kbits (i.e., 1280×3×8) per scan line. Furthermore, as a high resolution is heightened, a data amount to be processed is dramatically increased. Accordingly, since it is impossible for the selective write addressing method to display all the data with a high resolution with a limited time, there has been suggested a scheme of dividing a field into a plurality of blocks for a driving. However, a divisional driving of the field requires a greater number of driving circuits to drive each block to cause a cost rise.

In addition, the selective write addressing method requires a reset discharge for initializing all the cells by the entire write discharge so as to uniform a discharge condition such as internal electric fields of the discharge cells having kept an on state and the discharge cells having kept an off state at the previous sub-field. However, the reset discharge causes a spurious light generated every sub-field and failing to contribute to the brightness to thereby heighten a black level. Accordingly, a contrast ratio is reduced to deteriorate a display quality.

In order to solve such problems of the selective write addressing method having an insufficient sustain period, there has been suggested a selective erasure addressing method as shown in FIG. 6. The selective erasure addressing method generates a write discharge at all the cells to sufficiently form wall charges and then applies a scan pulse and a data pulse so as to selectively turn off a desired cell.

Referring to FIG. 6, at step S22, a write pulse is applied to all the cells of the panel to generate an entire write discharge, thereby allowing all the cells to be in an on state and forming wall charges sufficiently. At steps S24 to S28, the cells are selected in accordance with a display data to generate a wall charge erasure discharge at the cells to be turned to an off state with the aid of a scan pulse and a data pulse while sustaining sufficient wall charges formed at said step S22 without any discharge at the cells to be turned to an on state. At step S30, the sustain operation is performed to keep the on/off state of the cell determined at said steps S26 and S28 during the corresponding interval, thereby realizing a gray scale. Particularly, the cells in which the wall charges has been sufficiently kept without any discharge at said step S26 generates a sustain discharge during the corresponding interval. Subsequently, at step S32, an erasure operation allowing all the cells to have an off state is performed to prepare the next sub-field operation. At the next sub-field, the PDP repeats the operations of said steps S10 to S20.

Such a selective erasure addressing method requires a pulse width of about 1 μs so as to selectively turn off all the cells having an on state in the reset period by an erase discharge according to a data. Accordingly, the selective erasure addressing method permits a relatively high speed of driving in comparison to the selective write addressing method, so that it can improve the brightness owing to an increase of the sustain period and is suitable for realizing a high resolution picture. However, the selective erasure addressing method has a disadvantage in that the brightness at the off-state cell is too high in comparison to the selective write addressing method due to a light caused by the erase discharge. This reduces a contrast ratio to deteriorate a display quality. Moreover, the selective erasure addressing method requires a stable entire write discharge that allows all the cells to be in an on state at which wall charges are sufficiently formed in the reset period. To this end, since a stabilization discharge for equalizing the wall charges after the entire write discharge is added to the reset period, there is raised a problem in that a spurious light is increased to more deteriorate the contrast ratio.

As described above, the selective write addressing method and the selective erasure addressing method having been applied to the conventional PDP driving method have problems of a relatively long address period and a deterioration of contrast ratio. Therefore, there has been required a PDP driving method of improving a display quality while driving the PDP at a high speed.

SUMMARY OF THE INVENTION

Accordingly, it is an object of the present invention to provide a PDP driving method adopting a selective inversion addressing method wherein a data is written by a selective inversion system to permit a high-speed driving and a contrast improvement.

In order to achieve these and other objects of the invention, a PDP driving method according to an embodiment of the present invention includes a reset step of making an entire write discharge of cells to form wall charges; an address step of making an address discharge of specific cells of the cells undergoing said entire write discharge to invert the polarities of the wall charges of said specific cells and to keep the polarities of the wall charges according to said entire write discharge as they are at the remaining cells excluding said specific cells; and a sustain step of making a sustain discharge of only the specific cells having the inverted wall charge polarity by a sustain pulse.

In the method, the wall charge polarities of said specific cells at which said address discharge has been generate are inverted by a direct current level applied to all the cells at said address step.

Each of said cells includes a scan electrode, a sustain electrode and a data electrode. Said specific cells generate an address discharge by a scanning pulse and a data pulse applied to the scan electrode and the data electrode at said address step. The polarities of the wall charges formed at said specific cells after said address discharge are inverted by a direct current level applied to said sustain electrode.

A driving pulse applied upon said address discharge has a pulse width of less than 3 μs.

At said sustain step, said sustain pulse has a polarity contrary to the polarities of the wall charges of the remaining cells at which the polarities of the wall charges caused by said entire write discharge are kept as they are at said address step.

The method further includes a selective erase step of erasing the wall charges of the remaining cells at which the polarities of the wall charges caused by said entire write discharge as they are at said address step.

Said selective erase step includes applying an erase pulse consisting of a ramp pulse having a voltage decreasing gradually so as to erase the wall charges of said cells at which the polarities of the wall charges are kept as they are.

Said selective erase step further includes applying a second erase pulse consisting of a ramp pulse having a voltage increasing gradually so as to erase the wall charges of said cells at which the polarities of the wall charges are kept as they are.

The method further includes an erase step of applying an erase pulse to all the cells to erase the wall charges of all the cells just after said sustain step.

Said reset step includes allowing a relatively great amount of wall charges to be formed by an entire write discharge using a positive-going ramp pulse applied to the scan electrode and a positive bias voltage applied to the sustain electrode.

A PDP driving method according to another embodiment of the present invention includes a reset step of initializing cells; an address step of determining the cells to be any one of on and off states in accordance with a data; and a sustain step of keeping a state determined at said address step, said reset step including initializing all the cells by an entire write discharge using a positive-going ramp pulse applied to a scan electrode of each of the cells and a positive bias voltage applied to a sustain electrode of each of the cells.

In the method, said positive bias voltage applied to the sustain electrode has a step shape.

Said address step includes determining the cells having an on state at which the polarities of the wall charges caused by said entire write discharge are inverted by an address discharge according to said data and the cells having an off state at which the polarities of the wall charges caused by said entire write discharge are kept as they are.

Said sustain step includes allowing the cells having said on state to keep an on state by a sustain discharge using a sustain pulse and allowing the cells having said off state to keep an off state without any discharge.

A PDP driving method according to still another embodiment of the present invention includes a reset step of making an entire write discharge of cells to form wall charges; an address step of determining the cells having an on state at which the polarities of the wall charges caused by said entire write discharge are inverted by an address discharge according to said data and the cells having an off state at which the polarities of the wall charges caused by said entire write discharge are kept as they are; a selective erase step of erasing said wall charges having been kept at the cells having said off state; and a sustain step of allowing the cells having said on state to keep an on state by a sustain discharge using a sustain pulse and allowing the cells having said off state to keep an off state without any discharge.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 7:
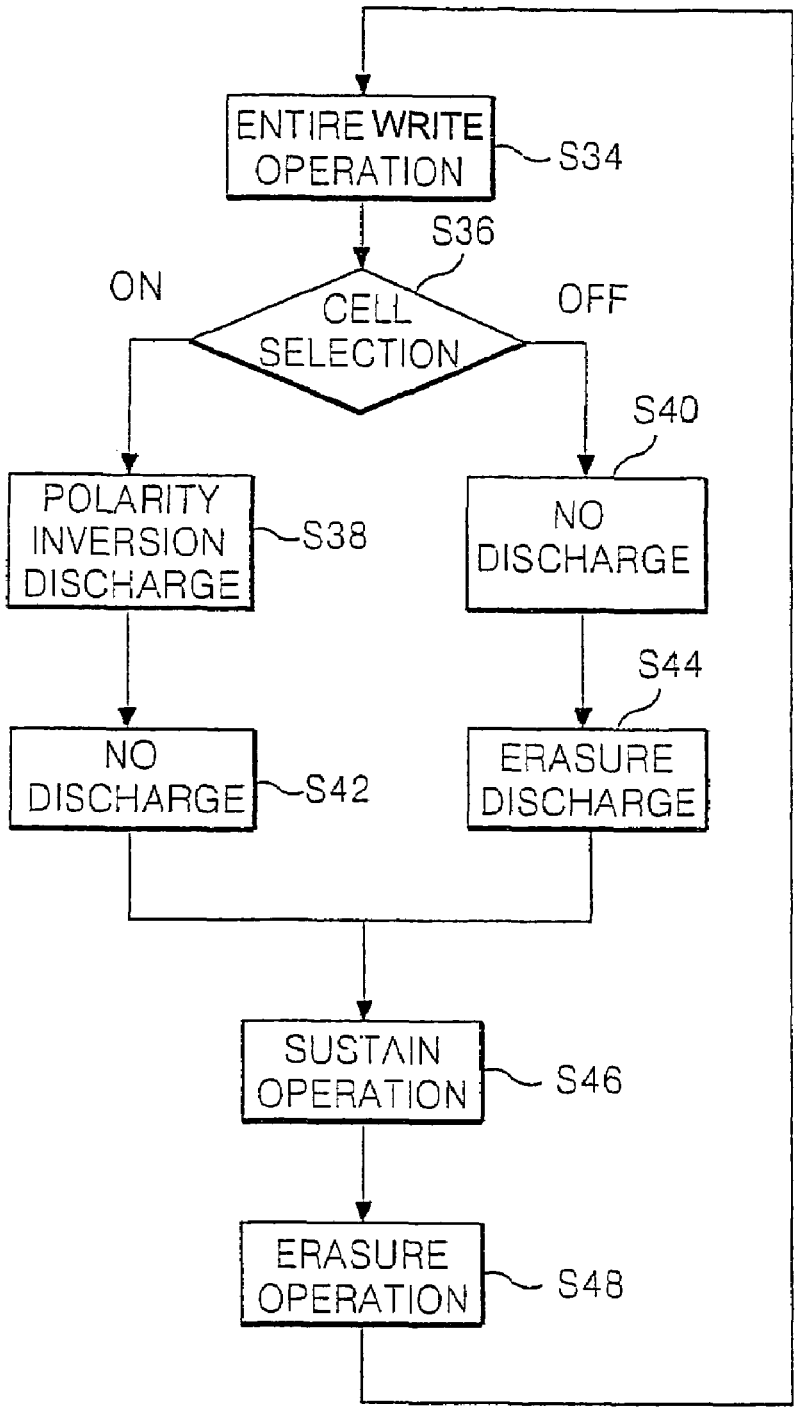
FIG. 7 is a flow chart representing a PDP driving method adopting a selective inversion addressing method according to an embodiment of the present invention.

FIG. 7 is a flow chart representing a PDP driving method adopting a selective inversion addressing method according to the present invention step by step. FIG. 8A to FIG. 8E are section views representing a wall charge state of the cells that are to kept an on state in accordance with the driving method shown in FIG. 7, whereas FIG. 9A to FIG. 9E are section views representing a wall charge state of the cells that are to kept an off state in accordance with the driving method shown in FIG. 7.

Figure 8A:
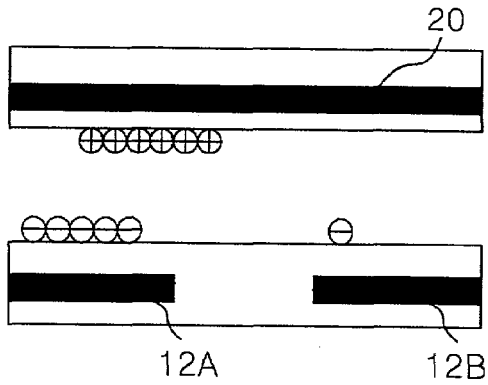
FIG. 8A to FIG. 8E sequentially represent a discharge mechanism of the discharge cell turned on in accordance with the driving method shown in FIG. 7.
Figure 9A:
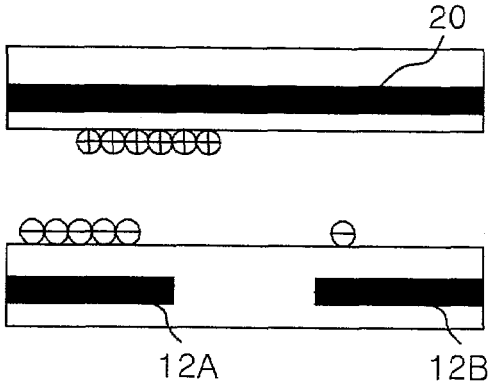
FIG. 9A to FIG. 9E sequentially represent a discharge mechanism of the discharge cell turned off in accordance with the driving method shown in FIG. 7.

At step S34 that is a reset period, a write pulse is applied to all the cells of the panel to generate an entire write discharge, thereby turning all the cells to an on state. By such an entire write operation, sufficient wall charges are formed at a dielectric layer on each scan electrode 12A, each sustain electrode 12B and each data electrode 20 of all the cells as shown in FIG. 8A and FIG. 9A.

Figure 8B:
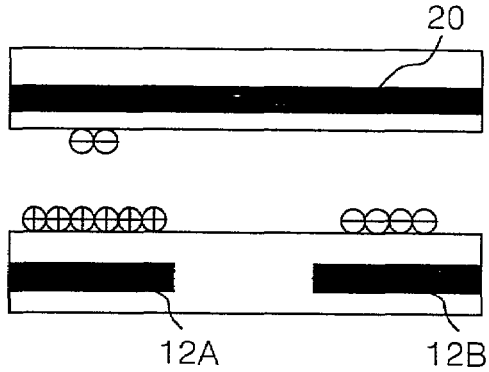
Figure 9B:
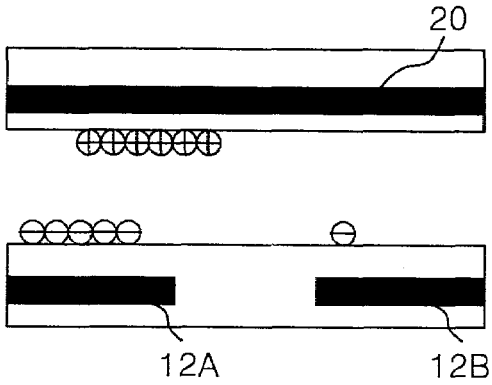

At steps S36 to S40 that are an address period, an address discharge is generated at the cells to be turned into an on state by a scan pulse applied to the scan electrode 12A and a data pulse applied to the data electrode 20 to invert the polarities of the wall charges; while a discharge is not generated at the cells to be turned into an off state to keep the previous polarities of the wall charges. Herein, for a selective inversion address discharge's sake, a narrow-width pulse of less than 3 μs (preferably less than 2 μs) is used as the scan pulse and the data pulse. The sustain electrode 12B is supplied with a specific direct current voltage that allows the polarities of the wall charges to be inverted by said address discharge. As a result, the polarities of the wall charges are inverted as shown in FIG. 8B by the address discharge at the cells to be turned into an on state while a discharge is not generated at the cells to be turned into an off state to keep the wall charge state having the same polarities as FIG. 9A that is the previous step as shown in FIG. 9B at the cells to be turned into an off state.

Figure 8C:
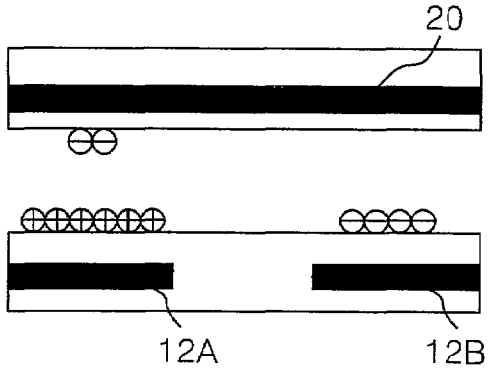
Figure 9C:
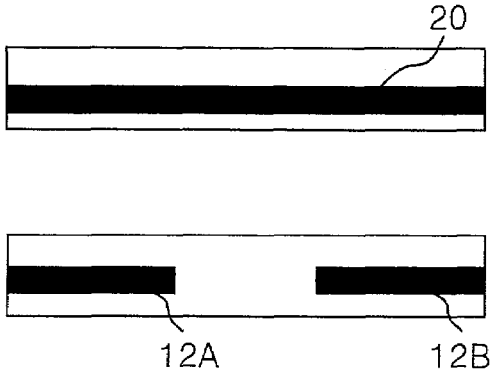

At steps S42 and S44 that are a selective erasure period, erase pulses are applied to all the cells to erase wall charges existing in the cells to be turned into an off state as much as possible. To this end, the polarity of the erase pulse is set such that is cancelled out by a wall charge polarity of the cell to be turned into an on state while being added to a wall charge polarity of the cell to be turned into an off state. By the erase pulse with such a polarity, a wall charge state having the same polarity as FIG. 8B that is the previous step is kept as shown in FIG. 8C at the cells to be turned into an on off state while wall charges are erased as shown in FIG. 9C at the cells to be turned into an off state.

Figure 8D:
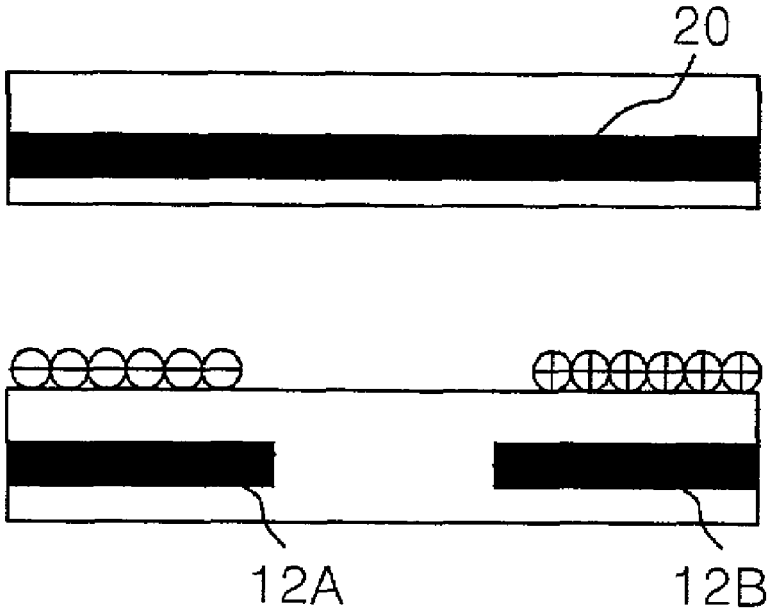
Figure 9D:
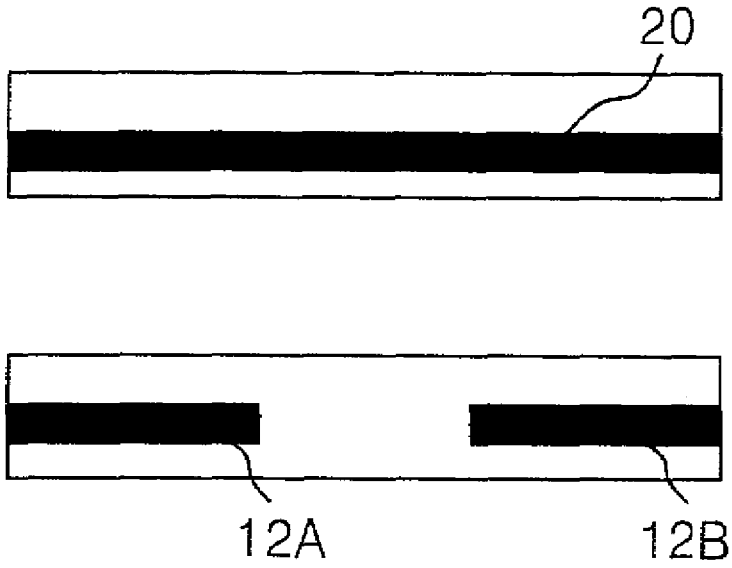

At step S46 that is a sustain period, sustain pulses are applied to all the cells to perform a sustain operation allowing the on/off state of the cell determined at said address and selective erase steps to be kept during the corresponding interval, thereby realizing a gray scale. Particularly, the cells having wall charges sufficiently formed by the polarity inversion at said address step keep an on state having sufficient wall charges during the corresponding interval as shown in FIG. 8D by a sustain discharge caused by the sustain pulses alternately applied to the scan electrode 12A and the sustain electrode 12B. On the other hand, the cells having wall charges erased at the erase step keep an off state as shown in FIG. 9D.

Figure 8E:
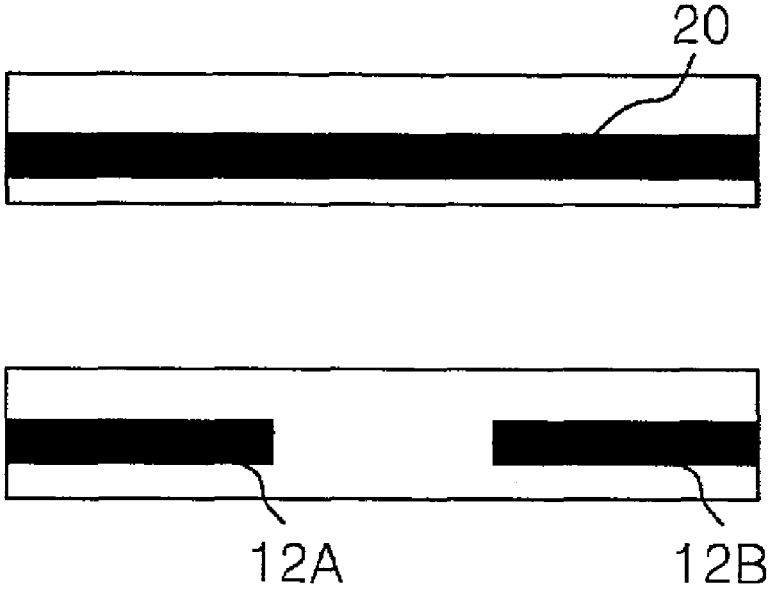
Figure 9E:
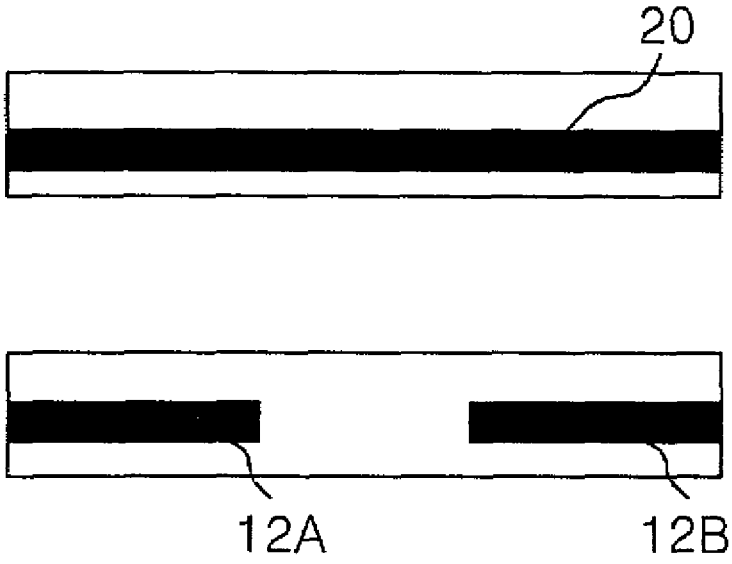

At step S48 that is an erase step, the entire wall charges of all the cells are erased by an erasure operation caused by the erasure pulse to turn all the cells into an off state. By this erasure operation, the entire wall charges are erased from all the cells as shown in FIG. 8E and FIG. 9E to prepare the next sub-field operation. At the next sub-field, the PDP repeats the operations of said steps S34 to S48.

As described above, the PDP driving method adopting the selective inversion addressing method according to the present invention turns all the cells into an on state by the entire write discharge. Then, the polarities of the wall charges are inverted only at the cells to be turned into an on state by the address discharge to thereby sustain the discharge in the following sustain period. Otherwise, the wall charges are erased with the aid of the erase pulse at the cells to be turned into an off state in which an initial wall charge polarity is kept to thereby prevent a generation of any discharge in the sustain period. Accordingly, the PDP driving method adopting the selective inversion addressing method according to the present invention uses a narrow-width pulse of less than 2 μs in the address period so that it can shorten the address period. As a result, the sustain period can be increased to such an extent corresponding to the shortened address period, thereby improving the brightness and being suitable for realizing a high resolution picture. Furthermore, the PDP driving method adopting the selective inversion addressing method according to the present invention prevents a discharge from being generated at the cells to be turned into an off state in the address period, so that it can prevent a deterioration of contrast ratio caused by a spurious light.

Figure 10:
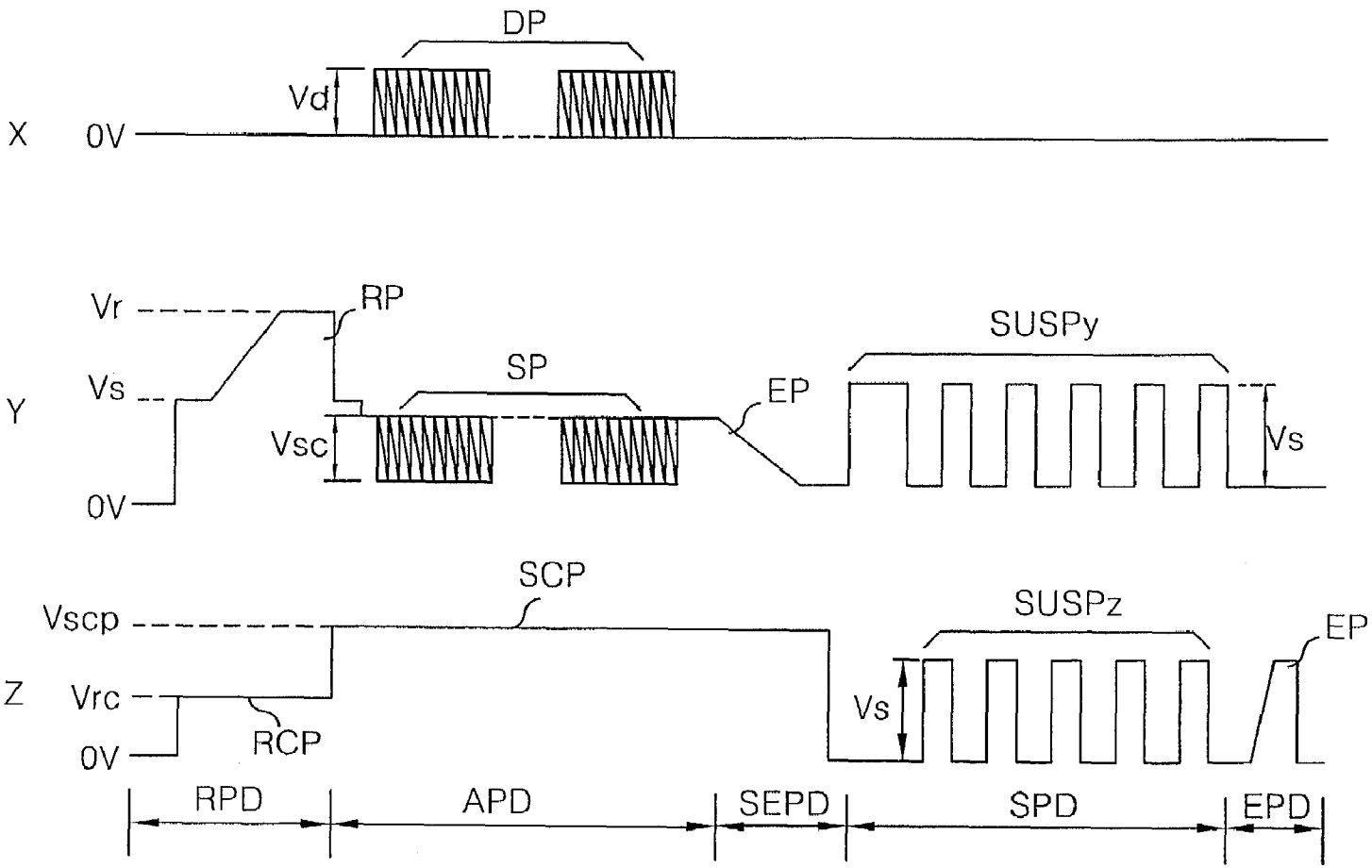
FIG. 10 illustrates a driving waveform applied to a PDP driving method according to an embodiment of the present invention.

FIG. 10 is a driving waveform diagram for explaining a PDP driving method adopting a selective inversion addressing method according to a first embodiment of the present invention. Herein, X represents a signal waveform applied to the data electrode 20; Y represents a signal waveform applied to the scan electrode 12A; and Z represents a signal waveform applied to the sustain electrode 12B, in one sub-field interval.

In FIG. 10, in the reset period RPD, a reset pulse RP is applied to all the scan electrodes 12A for the entire write discharge operation. A positive-going ramp pulse that jumps from a ground voltage 0V into a step voltage Vs and then slowly increases into a peak voltage Vr is used as the reset pulse RP. At this time, the sustain electrode 12B is supplied with a reset common pulse RCP keeping a voltage of Vrc to control a wall charge amount, and the data electrode 20 is fixed to a ground voltage 0V. Herein, the reset common pulse RCP applied to the sustain electrode 12B has a step shape. The entire write discharge is generated by such a reset pulse RP to form negative wall charges on the scan electrode 12A and the sustain electrode 12B while forming positive wall charges on the data electrode 20. Particularly, the entire write discharge caused by the positive-going ramp pulse can sufficiently wall charges while minimizing a light amount. The wall charges formed sufficiently as mentioned above are used in the next address period APD without an erasure discharge caused by the conventional negative-going ramp pulse. As a result, a discharge frequency in the reset period RPD can be reduced to improve the contrast ratio.

In the address period APD, a scan pulse SP having a voltage of Vsc is applied to the scan electrode 12A for each line and, at the same time, a data pulse DP having a voltage of Vd is applied to the data electrode 20 of the cell corresponding to a data '1', thereby generating an address discharge. Further, after such an application of the scan pulse SP, a direct current voltage for keeping the Vsc voltage is applied to the scan electrode 12A, thereby pulling electric charges produced by said address discharge to form wall charges. At this time, a scan common pulse SCP for keeping a positive Vscp voltage is applied to the sustain electrode 12B to pull electrons produced by said address discharge, thereby forming wall charges. As a result, the wall charges formed at the cells in which the address discharge has been generated in the address period APD have the polarities contrary to the wall charges formed in the reset period RPD. In other words, positive wall charges are formed on the scan electrode 12A of the cells at which the address discharge has been generated, whereas negative wall charges are formed on the sustain electrode 12B and the data electrode 20 thereof. In order to provide such an address discharge, that is, a polarity inversion discharge, the scan pulse SP and the data pulse DP is set to have a narrow pulse width of less than 2 μs. On the other hand, since the cells corresponding to a data '0' have not generated any discharge in the address period APD, the polarities of the wall charges formed in the reset period RPD are kept as they are.

If when an address operation for each line has been finished in the address period APD, an erase pulse EP is applied to all the scan electrode 12A in the next selective erasure period SEPD. A negative-going ramp pulse that slowly decreases from a scan voltage Vsc into a ground voltage 0V is used as the erasure pulse EP. Herein, the sustain electrode 12B and the data electrode 20 are fixed to a Vscp voltage and 0V, respectively. With the aid of the erase pulse EP decreasing gradually in this manner, wall charges existing in the cells at which the address discharge has not been generated in the address period APD are erased by a dark discharge.

Subsequently, sustain pulses SUSPy and SUSPz are alternately to the scan electrode 12A and the sustain electrode 12B in the sustain period SPD to keep a state of the cell determined in said address period APD and said selective erasure period. More specifically, the cells in which the polarity-inverted wall charges are sufficiently formed in the address period APD keep an on state owing to a discharge caused by the sustain pulses SUSPy and SUSPz, whereas the cells in which the wall charges are erased in the selective erasure period SEPD keep an off state as they are.

In the erase period EPD following such a sustain period SPD, an erase pulse EP is applied to the sustain electrode 12B to cause an erasure discharge, thereby erasing wall charges existing in all the cells. In this case, a positive-going ramp pulse is applied as the erase pulse EP so as to provide a small light-emission magnitude.

Figure 11:
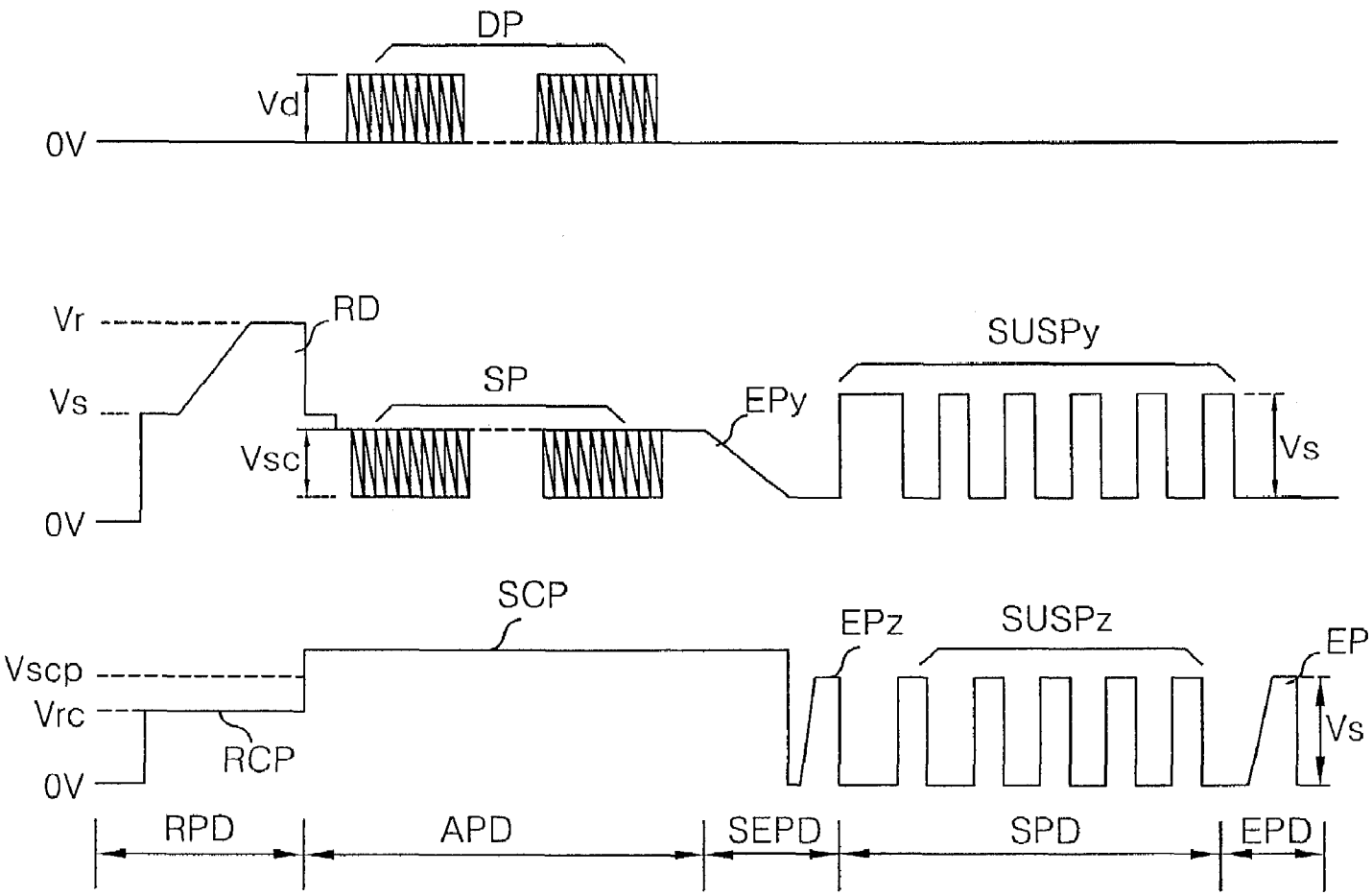
FIG. 11 illustrates a driving waveform applied to a PDP driving method according to another embodiment of the present invention.

FIG. 11 is a driving waveform diagram for explaining a PDP driving method adopting a selective inversion addressing method according to a second embodiment of the present invention. When the driving waveform shown in FIG. 11 is compared with the driving waveform shown in FIG. 10, only the driving waveforms applied to the cells in the selective erasure period SEPD have a considerable difference from each other while the driving waveforms applied to the cells in the remaining periods are identical to each other.

Figure 1:
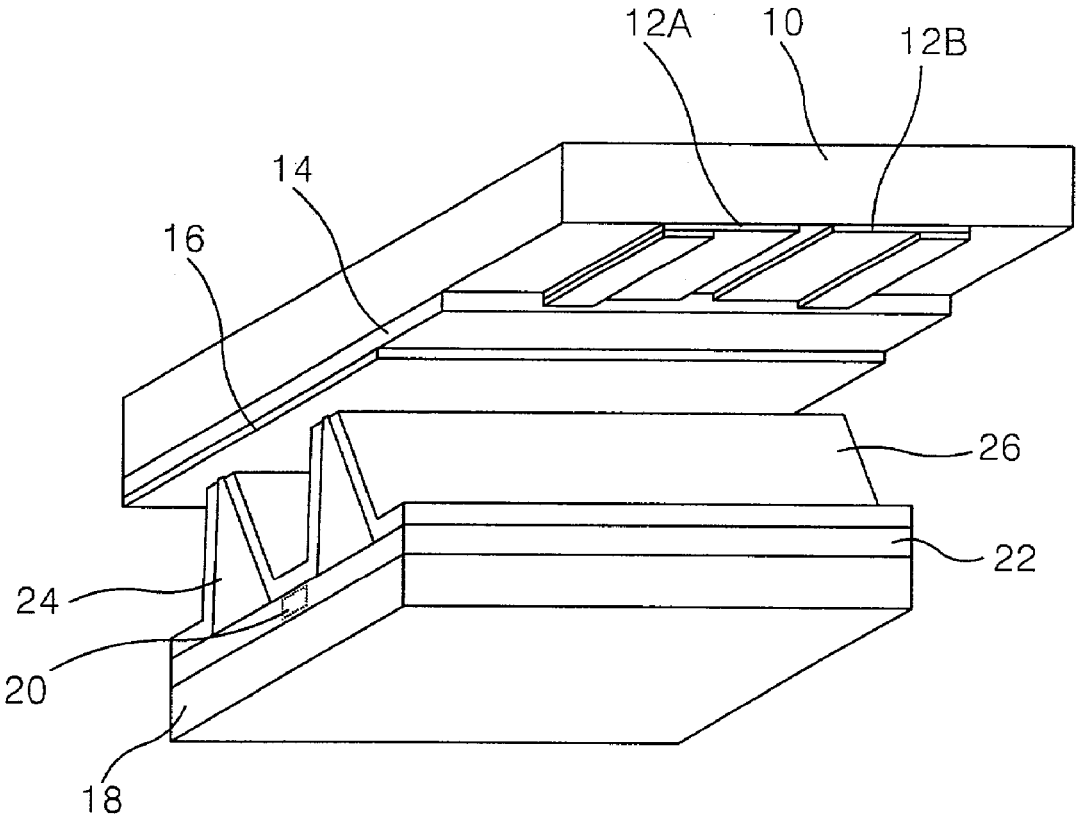
FIG.1 CONVENTIONAL ART
FIG. 1 is a section view showing a discharge cell structure of a conventional three-electrode, AC surface discharge plasma display panel.
Figure 2:
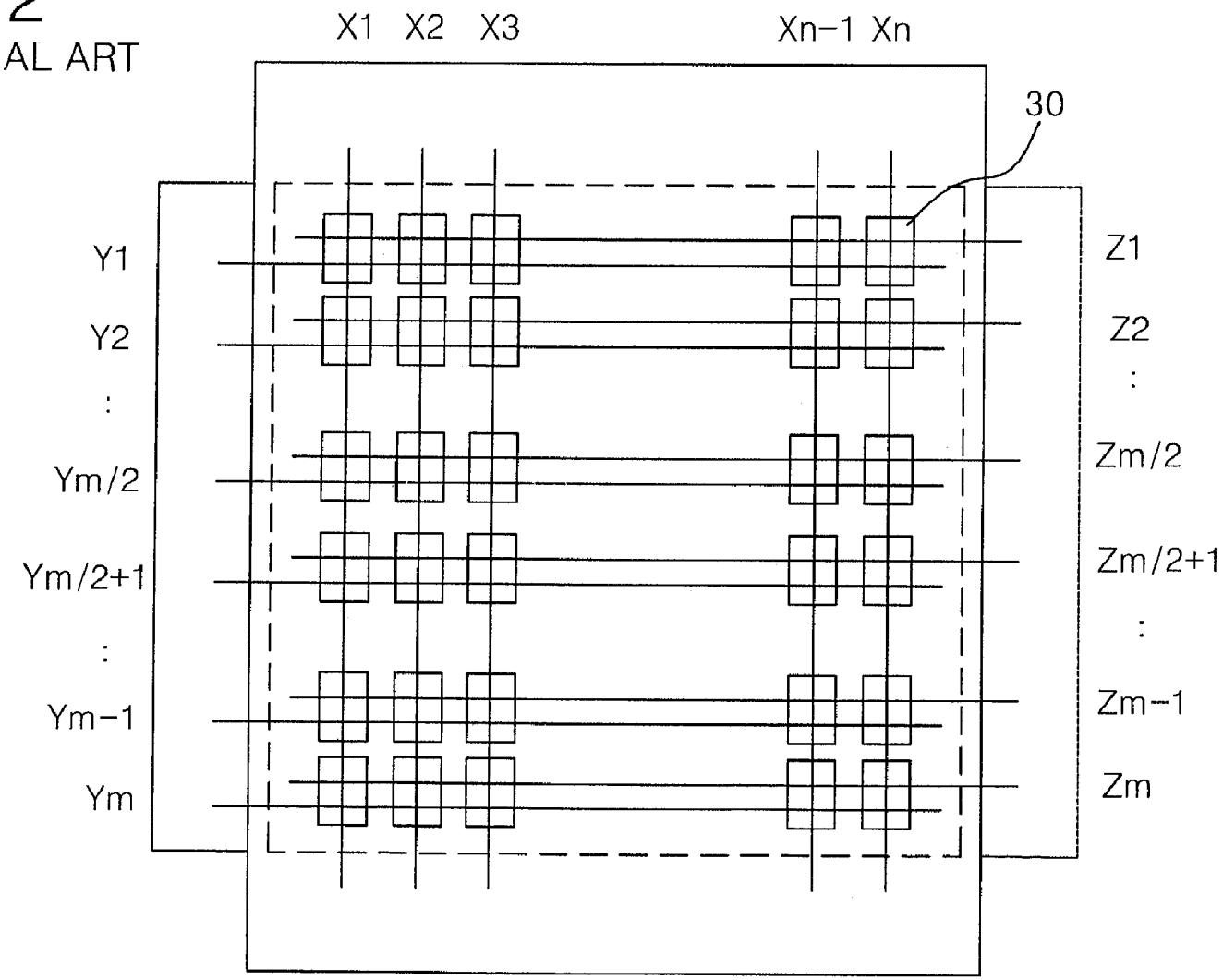
FIG. 2 CONVENTIONAL ART
FIG. 2 illustrates an electrode arrangement of a PDP consisting of cells shown in FIG. 1.
Figure 3:
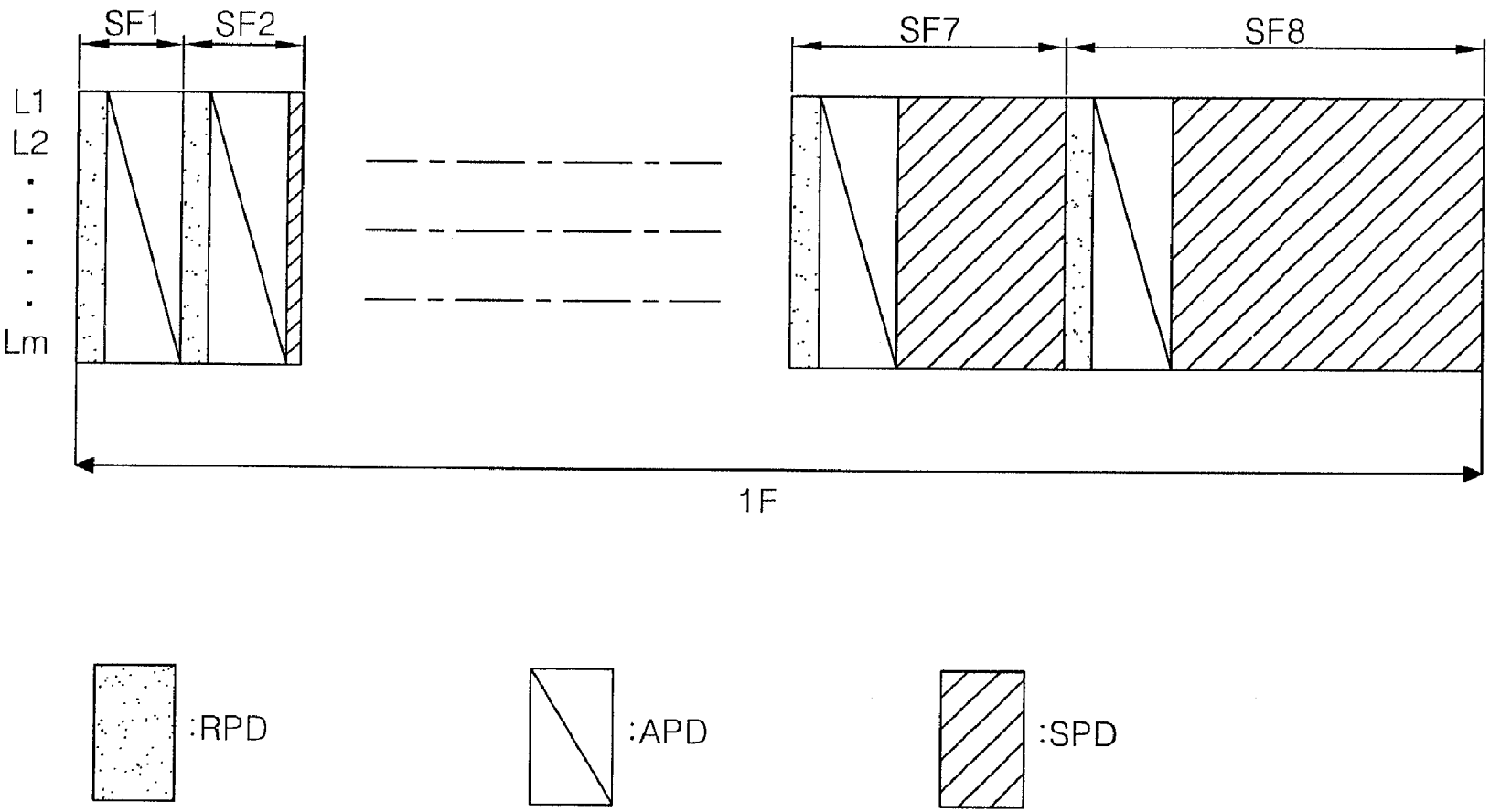
FIG.3 CONVENTIONAL ART
FIG. 3 illustrates a configuration of one frame according to a conventional sub-field driving method.
Figure 4:
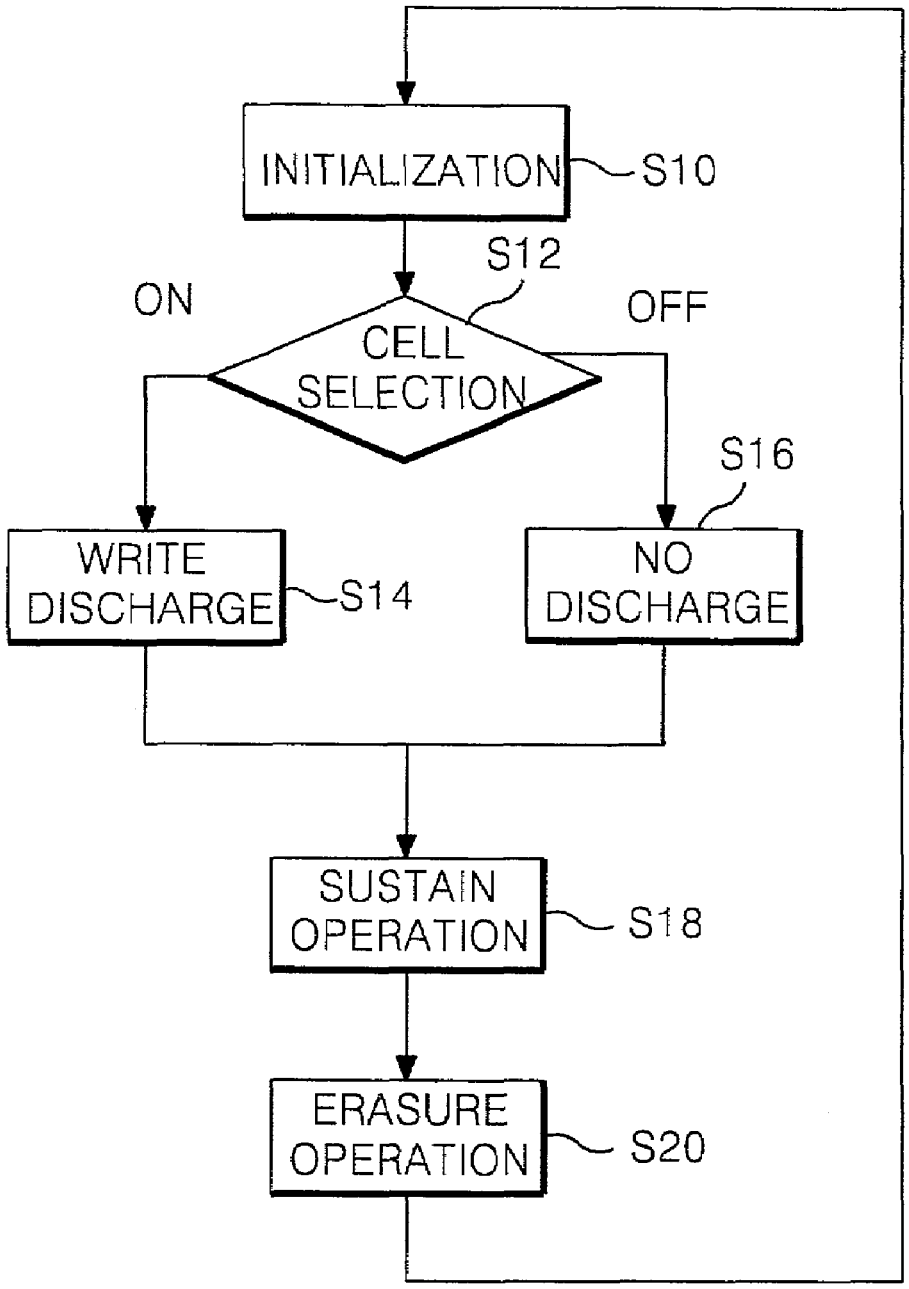
FIG. 4 CONVENTIONAL ART
FIG. 4 is a flow chart representing a PDP driving method adopting the conventional selective write addressing method.
Figure 5:
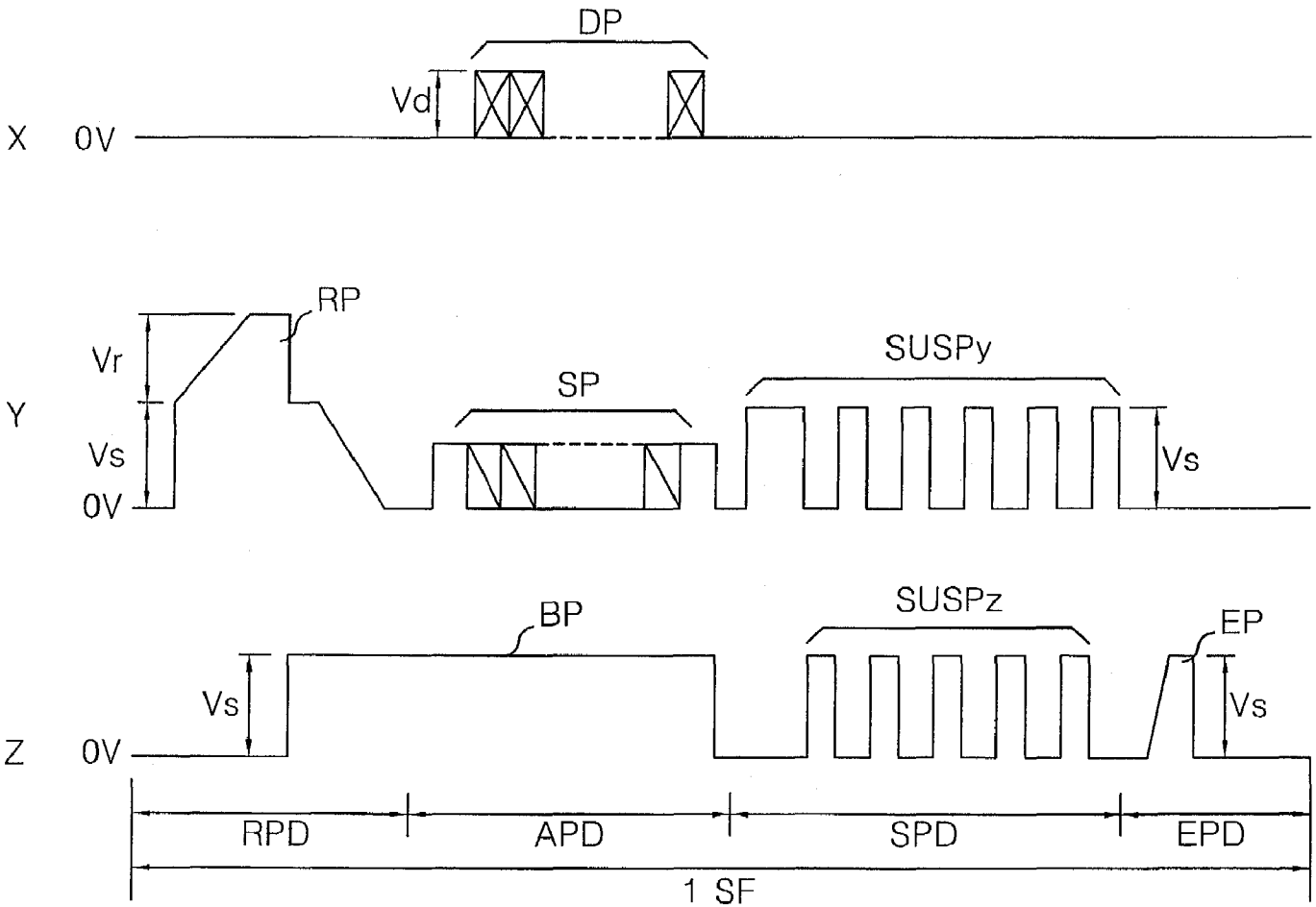
FIG.5 CONVENTIONAL ART
FIG. 5 illustrates a driving waveform applied to the PDP driving method shown in FIG. 4.
Figure 6:
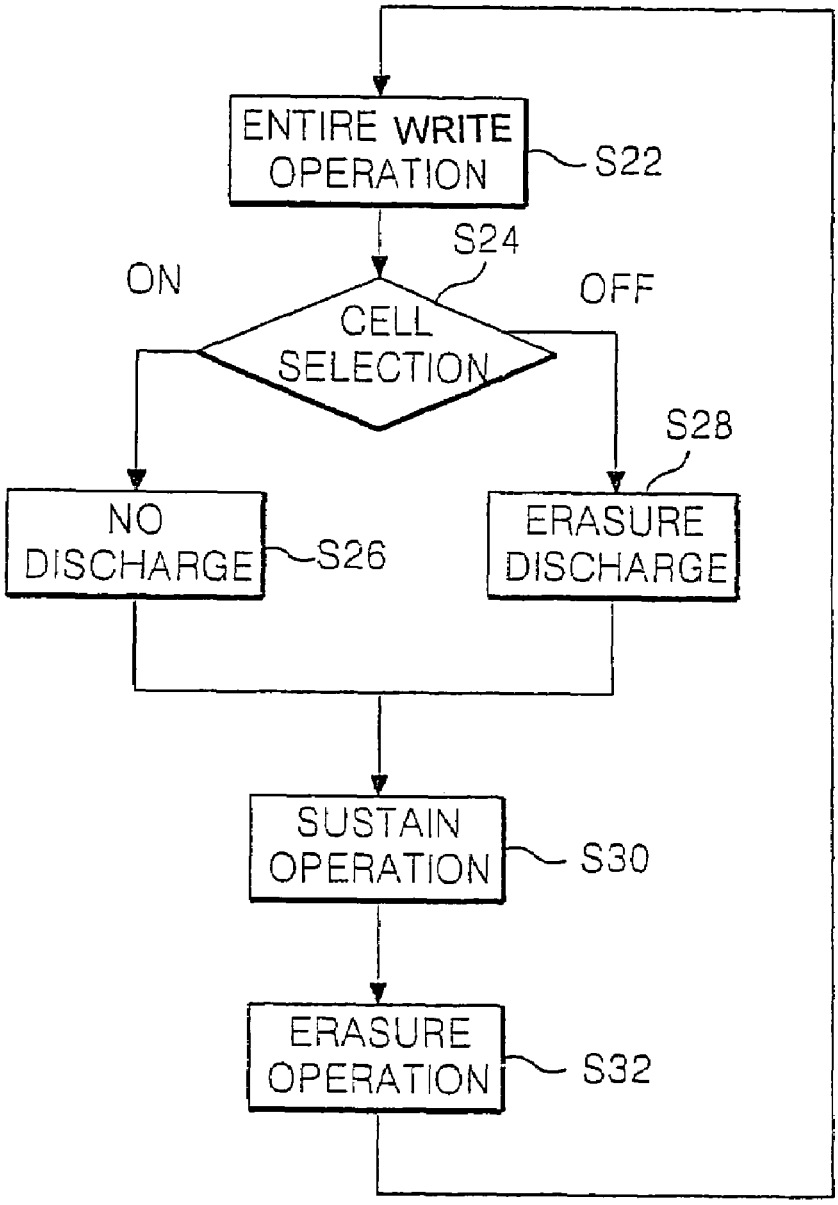
FIG. 6 CONVENTIONAL ART
FIG. 6 is a flow chart representing a PDP driving method adopting the conventional selective erasure addressing method.

In FIG. 11, in the reset period RPD, a reset pulse RP is applied to all the scan electrodes 12A for the entire write discharge operation. A positive-going ramp pulse that jumps from a ground voltage 0V into a step voltage Vs and then slowly increases into a peak voltage Vr is used as the reset pulse RP. At this time, the sustain electrode 12B is supplied with a reset common pulse RCP keeping a voltage of Vrc to control a wall charge amount, and the data electrode 20 is fixed to a ground voltage 0V. Herein, the reset common pulse RCP applied to the sustain electrode 12B has a step shape. The entire write discharge is generated by such a reset pulse RP to form negative wall charges on the scan electrode 12A and the sustain electrode 12B while forming positive wall charges on the data electrode 20. Particularly, the entire write discharge caused by the positive-going ramp pulse can sufficiently wall charges while minimizing a light amount. The wall charges formed sufficiently as mentioned above are used in the next address period APD without an erasure discharge caused by the conventional negative-going ramp pulse as shown in FIG. 5. As a result, a discharge frequency in the reset period RPD can be reduced to improve the contrast ratio.

In the address period APD, a scan pulse SP having a voltage of Vsc is applied to the scan electrode 12A for each line and, at the same time, a data pulse DP having a voltage of Vd is applied to the data electrode 20 of the cell corresponding to a data '1', thereby generating an address discharge. Further, after such an application of the scan pulse SP, a direct current voltage for keeping the Vsc voltage is applied to the scan electrode 12A, thereby pulling electric charges produced by said address discharge to form wall charges. At this time, a scan common pulse SCP for keeping a positive Vscp voltage is applied to the sustain electrode 12B to pull electrons produced by said address discharge, thereby forming wall charges. As a result, the wall charges formed at the cells in which the address discharge has been generated in the address period APD have the polarities contrary to the wall charges formed in the reset period RPD. In other words, positive wall charges are formed on the scan electrode 12A of the cells at which the address discharge has been generated, whereas negative wall charges are formed on the sustain electrode 12B and the data electrode 20 thereof. In order to provide such an address discharge, that is, a polarity inversion discharge, the scan pulse SP and the data pulse DP is set to have a narrow pulse width of less than 2 μs. On the other hand, since the cells corresponding to a data '0' has not generated any discharge in the address period APD, the polarities of the wall charges formed in the reset period RPD are kept as they are.

If when an address operation for each line has been finished in the address period APD, then a first erase pulse EPy is applied to all the scan electrode 12A in the next selective erasure period SEPD. A negative-going ramp pulse that slowly decreases from a scan voltage Vsc into a ground voltage 0V is used as the first erasure pulse EPy. Herein, the sustain electrode 12B and the data electrode 20 are fixed to a Vscp voltage and 0V, respectively. With the aid of the first erase pulse EPy decreasing gradually in this manner, wall charges existing in the cells at which the address discharge has not been generated in the address period APD are erased without any discharge. Then, a positive second erase pulse Epz is further applied to the sustain electrode 12B to erase wall charges existing in the cells at which the address discharge has not been generated as much as possible. A positive-going ramp pulse is used as the second erase pulse EPz.

Subsequently, sustain pulses SUSPy and SUSPz are alternately to the scan electrode 12A and the sustain electrode 12B in the sustain period SPD to keep a state of the cell determined in said address period APD and said selective erasure period. More specifically, the cells in which the polarity-inverted wall charges are sufficiently formed in the address period APD keep an on state owing to a discharge caused by the sustain pulses SUSPy and SUSPz, whereas the cells in which the wall charges are erased in the selective erasure period SEPD keep an off state as they are.

In the erase period EPD following such a sustain period SPD, an erase pulse EP is applied to the sustain electrode 12B to cause an erasure discharge, thereby erasing wall charges existing in all the cells. In this case, a positive-going ramp pulse is applied as the erase pulse EP so as to provide a small light-emission magnitude.

Figure 12:
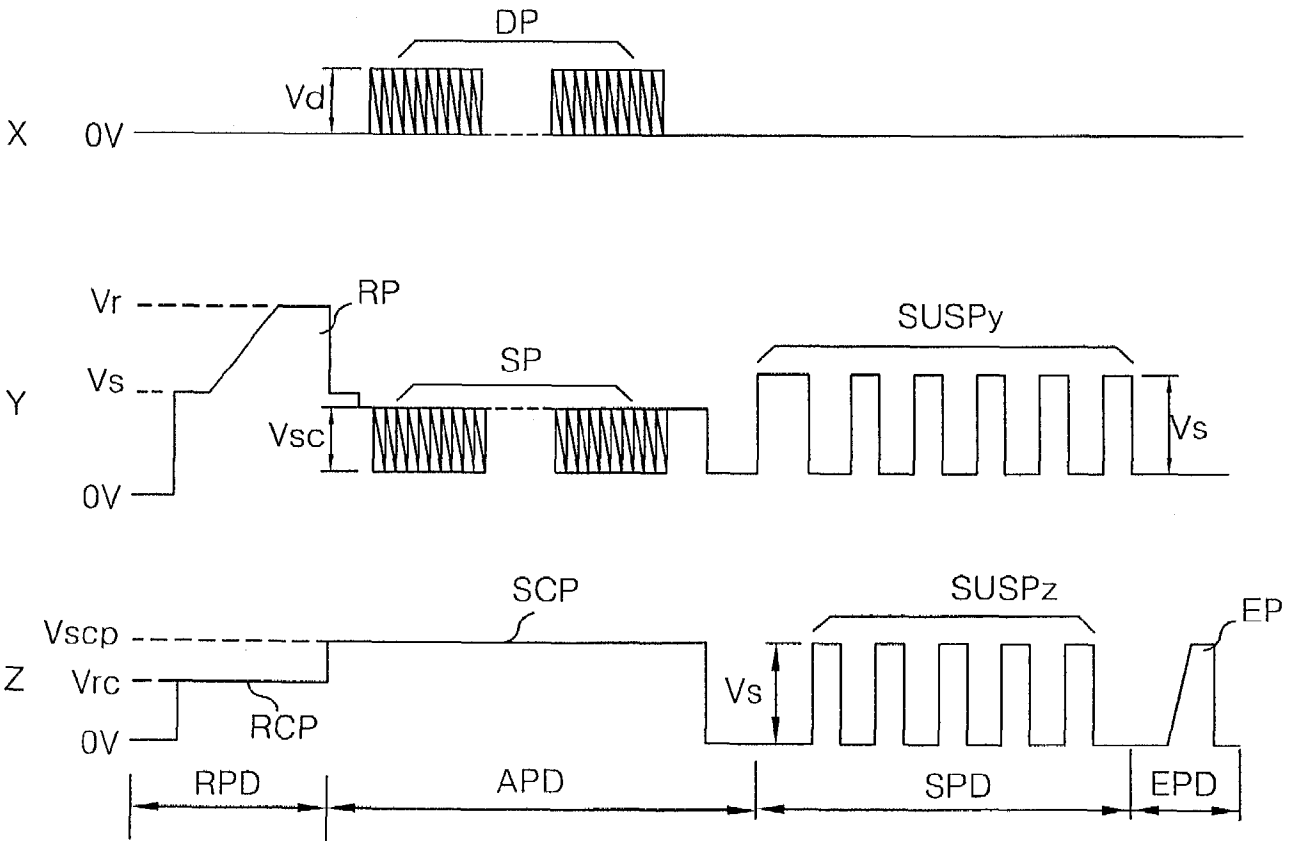
FIG. 12 illustrates a driving waveform applied to a PDP driving method according to still another embodiment of the present invention.

FIG. 12 is a driving waveform diagram for explaining a PDP driving method adopting a selective inversion addressing method according to a third embodiment of the present invention. When the driving waveform shown in FIG. 12 is compared with the driving waveforms shown in FIG. 10 and FIG. 11, the driving waveforms applied in the remaining periods other than the selective erasure period SEPD are identical to each other.

In FIG. 12, in the reset period RPD, a reset pulse RP is applied to all the scan electrodes 12A for the entire write discharge operation. A positive-going ramp pulse that jumps from a ground voltage 0V into a step voltage Vs and then slowly increases into a peak voltage Vr is used as the reset pulse RP. At this time, the sustain electrode 12B is supplied with a reset common pulse RCP keeping a voltage of Vrc to control a wall charge amount, and the data electrode 20 is fixed to a ground voltage 0V. Herein, the reset common pulse RCP applied to the sustain electrode 12B has a step shape. The entire write discharge is generated by such a reset pulse RP to form negative wall charges on the scan electrode 12A and the sustain electrode 12B while forming positive wall charges on the data electrode 20. Particularly, the entire write discharge caused by the positive-going ramp pulse can sufficiently wall charges while minimizing a light amount. The wall charges formed sufficiently as mentioned above are used in the next address period APD without an erasure discharge caused by the conventional negative-going ramp pulse as shown in FIG. 5. As a result, a discharge frequency in the reset period RPD can be reduced to improve the contrast ratio.

In the address period APD, a scan pulse SP having a voltage of Vsc is applied to the scan electrode 12A for each line and, at the same time, a data pulse DP having a voltage of Vd is applied to the data electrode 20 of the cell corresponding to a data '1', thereby generating an address discharge. Further, after such an application of the scan pulse SP, a direct current voltage for keeping the Vsc voltage is applied to the scan electrode 12A, thereby pulling electric charges produced by said address discharge to form wall charges. At this time, a scan common pulse SCP for keeping a positive Vscp voltage is applied to the sustain electrode 12B to pull electrons produced by said address discharge, thereby forming wall charges. As a result, the wall charges formed at the cells in which the address discharge has been generated in the address period APD have the polarities contrary to the wall charges formed in the reset period RPD. In other words, positive wall charges are formed on the scan electrode 12A of the cells at which the address discharge has been generated, whereas negative wall charges are formed on the sustain electrode 12B and the data electrode 20 thereof. In order to provide such an address discharge, that is, a polarity inversion discharge, the scan pulse SP and the data pulse DP is set to have a narrow pulse width of less than 2 μs. On the other hand, since the cells corresponding to a data '0' has not generated any discharge in the address period APD, the polarities of the wall charges formed in the reset period RPD are kept as they are.

If when an address operation for each line has been finished in the address period APD, then sustain pulses SUSPy and SUSPz are alternately to the scan electrode 12A and the sustain electrode 12B in the sustain period SPD to keep a state of the cell determined in said address period APD. More specifically, the cells in which the polarity-inverted wall charges are sufficiently formed in the address period APD keep an on state owing to a discharge caused by the sustain pulses SUSPy and SUSPz, whereas the cells in which the address discharge has not been generated keep an off state as they are. This is because the sustain pulses SUSPy and SUSPz applied to the scan electrode 12A and the sustain electrode 12B are added to the wall charges having the polarities inverted in said address period APD to generate a discharge while they are cancelled with respect to the wall charges keeping the polarities in the reset period RPD as they are to fail to generate any discharge. In this case, a voltage of each pulse applied in the reset period RPD, the address period APD and the sustain period SPD is controlled appropriately such that the wall charges keeping the polarities in the reset period RPD as they are at the cells having an off state does not interfere the sustain discharge.

In the erase period EPD following such a sustain period SPD, an erase pulse EP is applied to the sustain electrode 12B to cause an erasure discharge, thereby erasing wall charges existing in all the cells. In this case, a positive-going ramp pulse is applied as the erase pulse EP so as to provide a small light-emission magnitude.

As described above, according to the present invention, all the cells are turned into an on state at an initial time and an address discharge is generated only at the cells to be selectively turned on in accordance with a data, thereby inverting the polarities of the wall charges by the polarity of the following direct current voltage. Accordingly, a narrow wide pulse of less than 3 μs (preferably, less than 2 μs) is used in the address period to permit a high-speed driving, so that the sustain period can be enlarged to improve the brightness and to be suitable for realizing a high-resolution picture.

Furthermore, according to the present invention, a wall charge erasure discharge does not exist in the reset period to thereby reduce a discharge frequency and prevent a generation of discharge at the cells to be turned off in the address period. Accordingly, a contrast deterioration caused by a spurious light can be prevented. As a result, the PDP driving method employing the selective inversion addressing method according to the present invention can solve a problem of a low contrast ratio in the conventional selective erasure addressing method as well as a problem of a long address period of the conventional selective write addressing method.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel having a plurality of cells arranged in a matrix type each of said cells including a scan electrode, a sustain electrode and a data electrode, the method comprising:

a reset step of making an entire write discharge of the cells to form wall charges;

an address step of making an address discharge of specific cells of the cells undergoing said entire write discharge to invert the polarities of the wall charges of said specific cells and to keep the polarities of the wall charges according to said entire write discharge as they are at the remaining cells excluding said specific cells, wherein said specific cells generate an address discharge by a scanning pulse and a data pulse applied to the scan electrode and the data electrode at said address step, and the polarities of the wall charges formed at said specific cells after said address discharge are inverted by a direct current level applied to said sustain electrode; and a sustain step of making a sustain discharge of only the specific cells having the inverted wall charge polarity by a sustain pulse.

2. The method as claimed in claim 1, wherein a driving pulse applied upon said address discharge has a pulse width of less than 3 μs.

3. The method as claimed in claim 1, wherein at said sustain step, said sustain pulse has a polarity contrary to the polarities of the wall charges of the remaining cells at which the polarities of the wall charges caused by said entire write discharge are kept as they are at said address step.

4. The method as claimed in claim 1, further comprising:

a selective erase step of erasing the wall charges of the remaining cells at which the polarities of the wall charges caused by said entire write discharge as they are at said address step.

5. The method as claimed in claim 1, further comprising:

an erase step of applying an erase pulse to all the cells to erase the wall charges of all the cells just after said sustain step.

6. The method as claimed in claim 1, wherein said reset step includes:

allowing a relatively great amount of wall charges to be formed by an entire write discharge using a positive-going ramp pulse applied to the scan electrode and a positive bias voltage applied to the sustain electrode.

7. A method of driving a plasma display panel having a plurality of cells arranged in a matrix type, comprising:

a reset step of making an entire write discharge of the cells to form wall charges;

an address step of making an address discharge of specific cells of the cells undergoing said entire write discharge to invert the polarities of the wall charges of said specific cells and to keep the polarities of the wall charges according to said entire write discharge as they are at the remaining cells excluding said specific cells; and a sustain step of making a sustain discharge of only the specific cells having the inverted wall charge polarity by a sustain pulse, wherein the wall charge polarities of said specific cells at which said address discharge has been generated are inverted by a direct current level applied to all the cells at said address step.

8. A method of driving a plasma display panel having a plurality of cells arranged in a matrix type, comprising:

a reset step of making an entire write discharge of the cells to form wall charges;

an address step of making an address discharge of specific cells of the cells undergoing said entire write discharge to invert the polarities of the wall charges of said specific cells and to keep the polarities of the wall charges according to said entire write discharge as they are at the remaining cells excluding said specific cells;

a sustain step of making a sustain discharge of only the specific cells having the inverted wall charge polarity by a sustain pulse; and a selective erase step of erasing the wall charges of the remaining cells at which the polarities of the wall charges caused by said entire write discharge as they are at said address step, wherein said selective erase step includes:

applying a first erase pulse consisting of a ramp pulse having a voltage decreasing gradually so as to erase the wall charges of said cells at which the polarities of the wall charges are kept as they are.

9. The method as claimed in claim 8, wherein said selective erase step further includes:

applying a second erase pulse consisting of a ramp pulse having a voltage increasing gradually so as to erase the wall charges of said cells at which the polarities of the wall charges are kept as they are.

10. A method of driving a plasma display panel having a plurality of cells arranged in a matrix type, comprising:

a reset step of initializing the cells;

an address step of determining the cells to be any one of on and off states in accordance with a data; and a sustain step of keeping a state determined at said address step, wherein said reset step includes initializing all the cells by an entire write discharge using a positive-going ramp pulse applied to a scan electrode of each of the cells and a positive bias voltage applied to a sustain electrode of each of the cells, wherein said address step includes determining the cells having an on state at which the polarities of the wall charges caused by said entire write discharge are inverted by an address discharge according to said data and the cells having an off state at which the polarities of the wall charges caused by said entire write discharge are kept as they are, and wherein said sustain step includes allowing the cells having said on state to keep an on state by a sustain discharge using a sustain pulse and allowing the cells having said off state to keep an off state without any discharge.

* * * * *